United States Patent [19]

Ward

[11] 4,010,942

[45] Mar. 8, 1977

[54] REPAIR SUPPORT ASSEMBLY FOR AUTOMOTIVE TRANSMISSIONS

[76] Inventor: Gary Lee Ward, 4304 W. 182nd St., Torrance, Calif. 90504

[22] Filed: Mar. 4, 1974

[21] Appl. No.: 447,688

[52] U.S. Cl. ..... 269/15; 269/17; 269/46; 269/76; 269/261; 269/282; 269/321 W

[51] Int. Cl.[2] ..... B25B 1/22

[58] Field of Search ..... 269/15, 16, 17, 46, 269/59, 72, 76, 261, 262, 282, 283, 321 LU, 321 W

[56] References Cited

UNITED STATES PATENTS

| | | | |
|---|---|---|---|
| 246,632 | 9/1881 | Palmer | 269/262 |
| 449,987 | 4/1891 | Wies | 269/261 |
| 1,412,961 | 4/1922 | Periolat | 269/282 |
| 1,495,894 | 5/1924 | Du Bois | 289/76 |
| 1,611,738 | 12/1926 | Guilford | 269/283 |
| 2,703,252 | 3/1955 | Blackwell | 269/46 |
| 2,879,059 | 3/1959 | Sandefur | 269/17 |
| 2,985,448 | 5/1961 | Hancock | 269/15 |

FOREIGN PATENTS OR APPLICATIONS

| | | | |
|---|---|---|---|
| 182,901 | 2/1907 | Germany | 269/46 |

*Primary Examiner*—Roy Lake
*Assistant Examiner*—Mark S. Bicks
*Attorney, Agent, or Firm*—William C. Babcock

[57] ABSTRACT

A repair support for an automatic automotive transmission, which support includes first and second portions that may be separated and in combination with an overhead hoist permits a transmission after being removed from a vehicle to be raised and moved to a desired location where fluid may be drained from the transmission with the transmission thereafter being disposed in a stationary position where repair work may be performed conveniently thereon, and the repaired transmission thereafter being returned to a position adjacent the vehicle.

3 Claims, 5 Drawing Figures

REPAIR SUPPORT ASSEMBLY FOR AUTOMOTIVE TRANSMISSIONS

BACKGROUND OF THE INVENTION

1. Field of the Invention

Repair support assembly for automotive transmissions.

2. Description of the Prior Art

In the past few years automatic transmissions have come into wide spread use in automotive vehicles. Periodically such transmissions must be repaired. The repair of a transmission necessitates the removal thereof from a vehicle and the transportation of the transmission to a location where fluid can be drained therefrom. The transmission after fluid has been drained therefrom, must be manually moved to a bench or other support where repair work may be performed thereon. The repaired transmission must then be moved back to its original position in a vehicle and secured thereto.

Automatic transmissions are of substantial weight, are irregular in shape, and as a result, the handling of the transmission from the time it is removed from a vehicle until it is returned thereto requires considerable physical effort, as well as the ever present danger that the transmission may be dropped to damage the same and injure the person or persons moving the transmission from one location to another. Also, aside from the danger previously mentioned, the manual handling of transmissions is time consuming on the part of skilled personnel used in repairing the transmissions, and as a result their productiveness is decreased.

The primary purpose in devising the present invention is to supply a repair support assembly for an automatic automotive transmission that includes first and second portions, with the first portion capable of being moved to engage the transmission after the latter is removed from a vehicle, and the first portion in cooperation with an overheat hoist permitting the transmission to be moved to a desired location where a second portion of the invention is located to have fluide drained therefrom. The first and second portions thereafter cooperate to provide a support for the transmission while repair work is being performed thereon. After the repair work is being performed, the first portion of the invention is separated from the second portion, with the first portion and repaired transmission then being moved to a position where it may be placed in the vehicle. After the transmission is so disposed, the transmission is disengaged from the first portion thereafter returned to engage the second portion, and so remaining until the invention is again required in the repair of another transmission.

SUMMARY OF THE INVENTION

The invention comprises a first portion that includes an inverted U-shaped member having first and second free end portions, with the first end portion having a bar extending outwardly therefrom, and the first end also including a first threaded pin that extends towards a second pin. The second threaded pin is supported from the second end of the member and is in coaxial alignment with the first pin. A handle is provided for rotating the second pin.

The first and second pins are adapted to engage recesses or cavities formed in oppositely disposed side walls of automatic transmissions of the type that are currently used in General Motors vehicles. The U-shaped member at substantially the center thereof has a vertically extending tapped bore formed therein that is engaged by a threaded eye bolt. The first portion of the invention is capable of movably engaging a General Motors transmission after the latter is removed from a vehicle. The eye bolt may be engaged by the hook of an overhead hoist, and the hook and the first portion of the invention cooperating to permit the first portion to engage a General Motors type transmission which may then be raised and transported to a desired location.

At the desired location a second portion of the invention is located. The second portion of the invention includes a horizontal base that has a number of sides, and the base being supported on a number of spaced casters. The casters are preferably provided with brakes or stops to hold the base in a non-movable position at the desired location.

An upright having first and second ends is provided, with the upright having a horizontal tube secured to the upper first end thereof, and the second lower end of the upright being rigidly secured to one of the sides of the base. The tube is of such size that the bar of the first portion may be snuggly and slidably inserted therein. The tube has an internally threaded boss extending upwardly therefrom, with the boss threadedly engaging an externally threaded rod that has a handle on the upper end thereof. By rotating the handle and rod in an appropriate direction, the lower end of the rod may be brought into pressure frictional contact with the bar to secure the first portion of the invention and the transmission supported thereby in a desired position relative to the base. An open top receptacle is provided that is removably supported on the base, and so located that fluid may drain by gravity from the transmission thereinto. By tightening or loosening the threaded rod, the first portion of the invention and the transmission supported thereby may be disposed in any one of a number of positions in the second portion of the invention in which repair work on the transmission may be most conveniently carried out.

After the transmission has been repaired, the threaded rod is rotated in a direction to remove it from pressure contact with the bar, with the bar then being moved outwardly from the tube, and the first portion of the invention and the transmission supported thereby returned to a location where the transmission may be returned to a position adjacent the vehicle. After being so disposed, the second threaded pin is rotated to disengage it from the transmission, with the first portion of the invention thereafter being separated from the transmission and moved to a location where it may be secured to the second portion where it will so remain until the invention is again needed.

In certain types of automatic transmissions, such as used in vehicles manufactured by Ford and Chrysler, the transmissions are formed with flat, oppositely disposed side walls. When repair work is to be performed on such transmissions, first and second bodies having longitudinal recesses thereon are secured to the first and second pins. The body pivotally supports first and second pressure plates that have first and second corrugated surfaces that may be disposed in frictional supporting contact with the flat sides of an automatic transmission such as used in previously mentioned vehicles. The operation of the invention when the pressure plates are used to frictionally engage the side walls of a transmission is the same as when the first and second pins are caused to engage oppositely disposed recesses as previously mentioned.

DESCRIPTION OF THE PREFERRED EMBODIMENT

Figure 1:
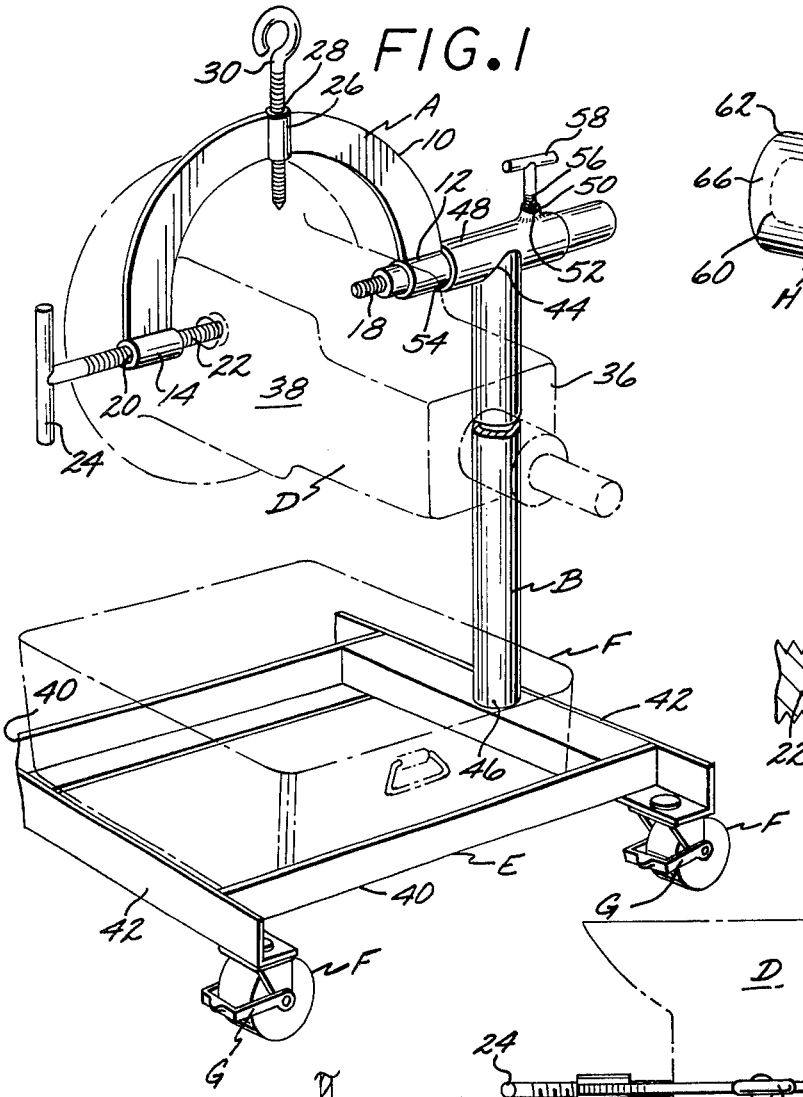
FIG. 1 is a perspective view of the invention, and illustrating the manner in which an automatic transmission of the type that has recesses formed in opposite side walls thereof is supported at a desired location, with the longitudinal axis of the transmission being substantially parallel to the horizontal surface on which the invention is supported.
Figure 2:
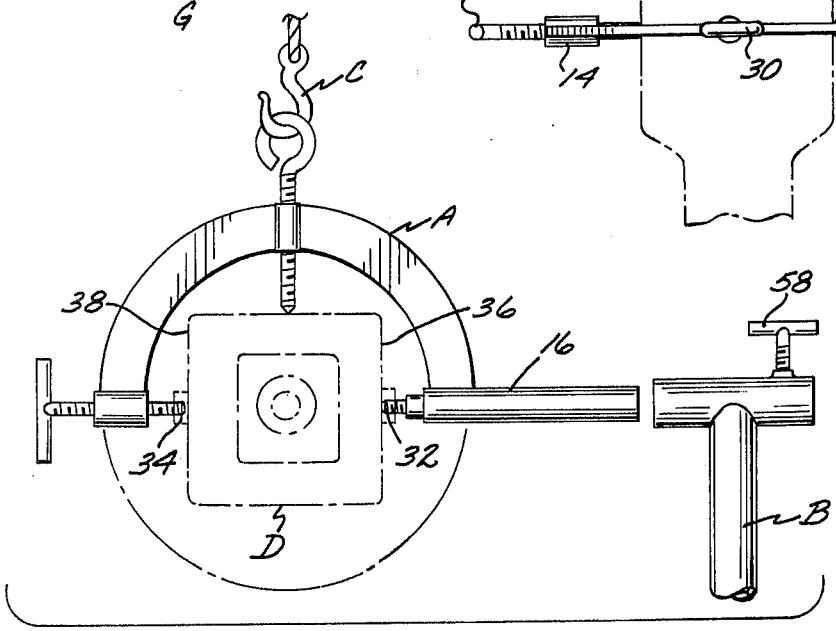
FIG. 2 is an end elevational view of the first portion of the device when supported from an overhead hoist, and prior to the first portion being placed in engagement with the second portion of the invention.

The first portion A of the invention is shown in FIGS. 1 and 2, and in FIG. 2 it will be seen that it may be separated from the second portion B when supported from a hook C of a movable overhead hoist (not shown). The first portion A as may be seen in FIGS. 1 and 2 includes an inverted, generally U-shaped member 10 that has first and second free ends 12 and 14. A rigid bar 16 of substantial transverse cross section extends outwardly from the first end 12 as best seen in FIG. 2.

The first end 12 also supports a first externally threaded pin 18 that is stationary. The second end 14 is of enlarged transverse cross section and has a tapped bore 20 extending longitudinally therethrough that engages a second threaded pin 22. The second pin 22 may be rotated by a handle 24 secured to the outer end thereof.

The center 26 of the U-shaped member 10 is of thickened transverse cross section and has a tapped bore 28 extending downwardly therethrough. Bore 28 is threadedly engaged by an eye bolt 30. The eye bolt 30 as may best be seen in FIG. 2 may be engaged by the hook C. A transmission D of the type used in General Motors vehicles is illustrated in phantom line in FIG. 1, and with first and second pins 18 and 22 in engagement with first and second recesses 32 and 34 formed in opposite side walls 36 and 38 of the transmission.

The first portion A of the invention may initially be placed in engagement with the transmission D while the latter is in an automotive vehicle (not shown). Eye bolt 30 is then engaged by the hook C, and the overhead hoist (not shown) then being used to raise the first portion A of the invention and the transmission D upwardly. The first portion A and transmission D are then moved to a desired location where the first portion A of the invention is removably secured to the second portion B thereof.

The second portion B of the invention includes a horizontal base E that is conveniently defined by angle iron side pieces 40 and end pieces 42 that are secured to one another by conventional means such as welding or the like. The side pieces 40 and end pieces 42 cooperate to provide a cradle in which a transmission fluid receiving receptacle F may be removably disposed. Fluid may be drained from the transmission D into receptacle F prior to repair work being performed on the transmission.

A number of spaced casters F of conventional design are secured to corner portions of the base E by conventional means. The casters F preferably have brakes or stops G operatively associated therewith to maintain the base E at a desired location on a floor surface (not shown), that supports the invention.

The upright B has first and second ends 44 and 46 with the first end supporting a horizontal tube 48 of such size that the bar 16 may be snuggly and slidably inserted within the interior thereof. The tube 48 is substantially horizontal and has a boss 50 extending upwardly therefrom in which a tapped bore 52 is formed that communicates with the interior 54 of tube 48.

The tapped bore 52 is threadedly engaged by a threaded rod 56 that has a handle 58 rigidly secured to the upper end thereof. After the first portion A of the invention and supported transmission D have been moved to the position shown in FIG. 2, they are further moved to dispose the bar 16 within the interior 54 of the tube 48, with the handle 58 thereafter being rotated in an appropriate direction to bring the threaded rod 56 into pressure contact with the external surface of the bar 16.

Figure 3:
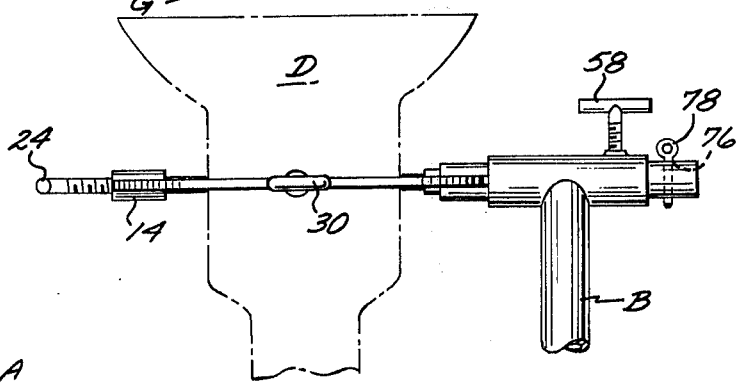
FIG. 3 is a side elevational view of the upper portion of the invention shown in FIG. 1, but after the first portion of the invention has been disposed in a position where the longitudinal axis of the transmission is substantially normal to the supporting ground surface.

By tightening or loosening the rod 56 the transmission may be supported horizontally as illustrated in FIG. 1, vertically as shown in FIG. 3, or in an angular position intermediate therebetween. Prior to the repair work being performed on the transmission D fluid is drained therefrom by loosening the appropriate plate (not shown) to permit fluid to drain by gravity from the transmission D to receptacle F. After the fluid is so drained from the transmission D, the threaded rod 56 is rotated to remove it from pressure contact with bar 16, with the transmission and first portion A then being rotated relative to the second portion B to a location where work may be conveniently performed on the transmission. The rod 56 is now tightened to again pressure contact bar 16 and maintain the first portion A and transmission D in this location.

After the repair work has been performed, the threaded rod 56 is loosened from contact with the bar 16, and the bar 16 then moved to a disengaged position from the tube 48. The hoist supported hook C is now used to move the first portion A and repaired transmission D back to its interior position in an automotive vehicle (not shown). After the transmission D is secured to the vehicle the handle 24 is rotated in an appropriate direction to disengage the second pin 22 from the second recess 34, whereby the first pin 18 may be disengaged from the first recess 32. The first portion A is now lifted upwardly by the hoist supported hook C, and returned to a position where it engages the second portion B as shown in FIG. 1 where it will so remain until again needed for transmission repair purposes.

Figure 4:
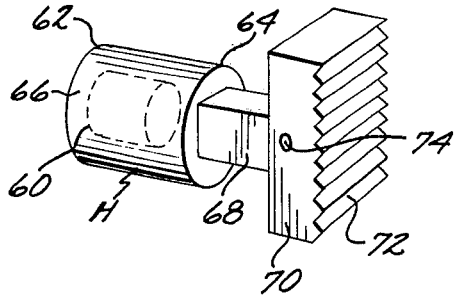
FIG. 4 is a perspective view of a first pressure plate unit.
Figure 5:
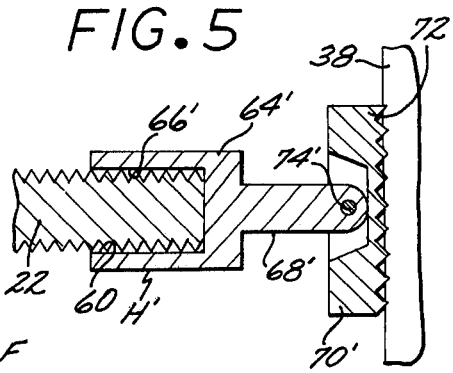
FIG. 5 is a longitudinal cross sectional view of a second pressure plate unit of the type that engages and is supported from the second threaded pin.

When a transmission D is encountered that does not have recesses 32 and 34 formed in the oppositely disposed side walls thereof, first and second units H and H′ may be utilized that are illustrated in FIGS. 4 and 5. The first unit H includes a cylindrical body 60 that has first and second end 62 and 64 with the first end having a tapped recess 66 extending inwardly therefrom into the body. The first end 64 has a lug 68 extending forwardly therefrom that pivotally supports a first pressure plate 70 that has corrugated surface 72 defined by a material that is harder than the material of the transmission D that defines the side walls 36 and 38. The pressure plate surface 72 may normally be steel as it is harder than the aluminum alloy that normally defines the side walls of an automatic transmission D.

The unit H is adapted to be removably secured to the first pin 18 by causing the pin to engage the tapped recess 56. The plate 70 is supported from the lug 58 by a transverse pin 74. The unit H′ shown in FIG. 5 is identical with the unit H, other than that the bore 66′ has no threads formed therein and rotatably engages the threaded pin 22. Portions of the second unit H′ that are identical to the first unit H are designated in the drawing by the same numbers as previously used in describing the unit H but with the primes affixed thereto. The unit H is slipped into the second pin 22 and the handle 24 rotated to move the second pin 22 towards the first pin 18 and the pressure plate 70′ into frictional pressure engaging contact with the second side wall 38. The transmission D is now frictionally gripped between the plates 70 and 70′ and the transmission by use of the first portion A and hoist supported hook C which may be raised from the vehicle (not shown) and moved to a position where the first portion A is supported from the second portion B of the invention. The transmission D may then be repaired, and after such repair the transmission may be returned to its initial position adjacent a vehicle (not shown) as previously described.

Should it be desired, and as a safeguard, the bar 16 may have a transverse aligned bore 76 formed therein through which a rigid pin 78 may be removably extended to prevent first portion A being inadvertently disengaged from tube 48.

The use and operation of the invention has been described previously in detail and need not be repeated.

I claim:

1. A device for removably supporting an automatic, fluid containing, automotive transmission of either the type that has flat opposed side walls or side walls in which transversely aligned cavities are formed, during the time repair work is being performed on said transmission, said device including:

a. a rigid horizontal base that has a plurality of sides;

b. a plurality of spaced casters that depend from said base and are capable of movably supporting said base above a flat floor surface;

c. an open top fluid receiving receptacle removably supported on said base;

d. a vertical upright that has first and second ends, with said first end rigidly secured to one of said sides of said base;

e. a horizontal tube secured to said second end of said upright, said tube including a transversely positioned outwardly extending boss in which a tapped bore is formed;

f. a threaded rod that engages said tapped bore;

g. a first handle secured to said rod for rotating the latter;

h. a transmission supporting assembly that includes a rigid generally U-shaped member having first and second ends, first means extending inwardly from said first and second ends to removably support one of said transmissions therebetween, said first means including 1. a first externally threaded pin that is secured to said first end of said U-shaped member;

2. a second threaded pin rotatably supported in a tapped bore formed in said second end of said U-shaped member, said second pin transversely aligned with said first pin;

3. A second handle secured to said second pin for rotating the same relative to said tapped bore in which said second pin is supported to move said second pin towards or away from said first pin when said second pin is rotated by said handle in an appropriate direction;

4. first and second bodies having first and second recesses therein that are engaged by said first and second pins;

5. first and second pressure plates pivotally supported on the most adjacently disposed ends of said first and second bodies when the latter are supported from said pins, said first and second pressure plates including first and second corrugated surfaces defined by a material that is of greater hardness than that of the portion of said transmission that said plates will contact, with said pressure plates having said corrugated surfaces thereof forced into frictional supporting contact with the sides of said transmission when said second handle is rotated in an appropriate direction to lessen the distance between said first and second bodies, second means secured to said U-shaped member that may be secured to the hook of a hoist to permit said assembly and a transmission supported thereby to be moved from an automotive vehicle to a position adjacent said device, and a bar extending outwardly from said first end of said U-shaped member, said bar capable of being slidably inserted in said tube and held in a non-rotatable position therein when said first handle is rotated in a direction to move said threaded rod into pressure frictional contact with said bar, when said bar is so engaged supporting said U-shaped member and transmission supported thereby over said receptacle in a first position to permit fluid in said transmission to drain downwardly therefrom by gravity into said receptacle, and said threaded rod when subsequently loosened and again tightened permitting said assembly and transmission supported thereby to be pivoted to and supported in a second position where repair work may be conveniently carried out on said transmission.

2. A device as defined in claim 1 in which said first recess is tapped and threadedly engaged by said first pin to support said first pressure plate on a desired pivotal axis relative to said generally U-shaped member.

3. A device as defined in claim 2 in which said second recess is of circular transverse cross section, has a bottom, has a straight side wall, and is rotatably engaged by said second pin, with said second plate being urged into pressure contact with said transmission when said second pin is in pressure contact with said bottom.

* * * * *